US008689675B2

(12) United States Patent
McCarty

(10) Patent No.: US 8,689,675 B2
(45) Date of Patent: Apr. 8, 2014

(54) FIELD ADJUSTABLE PISTON ACTUATORS

(75) Inventor: Michael W. McCarty, Marshalltown, IA (US)

(73) Assignee: Fisher Controls International, LLC, Marshalltown, IA (US)

( * ) Notice: Subject to any disclaimer, the term of this patent is extended or adjusted under 35 U.S.C. 154(b) by 888 days.

(21) Appl. No.: 12/363,496

(22) Filed: Jan. 30, 2009

(65) Prior Publication Data

US 2010/0192765 A1 Aug. 5, 2010

(51) Int. Cl.
*F15B 15/24* (2006.01)

(52) U.S. Cl.
USPC ..... 92/13.41; 92/13.6

(58) Field of Classification Search
USPC ..... 92/13.41, 13.6
See application file for complete search history.

(56) References Cited

U.S. PATENT DOCUMENTS

| | | | | | |
|---|---|---|---|---|---|
| 2,222,819 | A * | 11/1940 | Light | ..... | 92/13.6 |
| 2,804,944 | A * | 9/1957 | Talbott | ..... | 92/18 |
| 3,309,116 | A * | 3/1967 | Johnson et al. | ..... | 92/13.41 |
| 3,884,125 | A * | 5/1975 | Massie | ..... | 92/13.6 |
| 4,169,405 | A * | 10/1979 | Tsunemoto et al. | ..... | 92/13.6 |
| 6,487,960 | B1 * | 12/2002 | Chatufale | ..... | 92/13.6 |

FOREIGN PATENT DOCUMENTS

| | | | |
|---|---|---|---|
| DE | 10 2005 025 423 | A1 | 12/2006 |
| FR | 2 526 883 | A1 | 11/1983 |
| JP | 2004176888 | | 6/2004 |
| JP | 2008057604 | | 3/2008 |
| NL | 6 701 438 | A | 7/1968 |
| NL | 6701438 | | 7/1968 |

OTHER PUBLICATIONS

Emerson Process Management, "Type 585C Piston Actuators", Product Bulletin, Nov. 2007, 28 pages.
Japanese Patent Office, "Notice of Reason for Rejection," issued in connection with Japanese Patent Application No. 2011-547950 on Dec. 3, 2013, 2 pages.

* cited by examiner

*Primary Examiner* — F. Daniel Lopez
(74) *Attorney, Agent, or Firm* — Hanley, Flight and Zimmerman, LLC

(57) ABSTRACT

Field adjustable piston actuators are described. An example field adjustable piston actuator includes a housing having opposing openings and a chamber. Additionally, the example piston actuator includes a first plate coupled to the housing and adjacent one of the opposing openings. Further, the example piston actuator includes a second plate coupled to a yoke and the housing. The second plate is adjacent the other one of the opposing openings. Further still, the piston actuator includes a volume adjuster to provide field adjustment to change a volume of the chamber.

26 Claims, 12 Drawing Sheets

FIELD ADJUSTABLE PISTON ACTUATORS

FIELD OF THE DISCLOSURE

This patent relates generally to actuators and, more particularly, to field adjustable piston actuators.

BACKGROUND

Control valves (e.g., linear valves, rotary valves, etc.) are commonly used in process control systems to control the flow of process fluids. A control valve typically includes an actuator (e.g., a pneumatic actuator, hydraulic actuator, etc.) to automate operation of the control valve. In practice, different stroke lengths are required for different applications. The stroke length of known actuators may be adjusted by interchanging different size travel stops positioned in a chamber of the actuator. While interchanging different size travel stops enables the stroke lengths of these known actuators to be changed, the overall volume of the chamber remains the same. As a result, in some instances, the volume of the chamber may be too large for a particular application, which can compromise the dynamic performance of the actuator in that application.

SUMMARY

Field adjustable piston actuators are described. An example field adjustable piston actuator includes a housing having opposing openings and a chamber. Additionally, the example piston actuator includes a first plate coupled to the housing and adjacent one of the opposing openings. Further, the example piston actuator includes a second plate coupled to a yoke and the housing. The second plate is adjacent the other one of the opposing openings. Further still, the piston actuator includes a volume adjuster to provide field adjustment to change a volume of the chamber.

DETAILED DESCRIPTION

Figure 1:
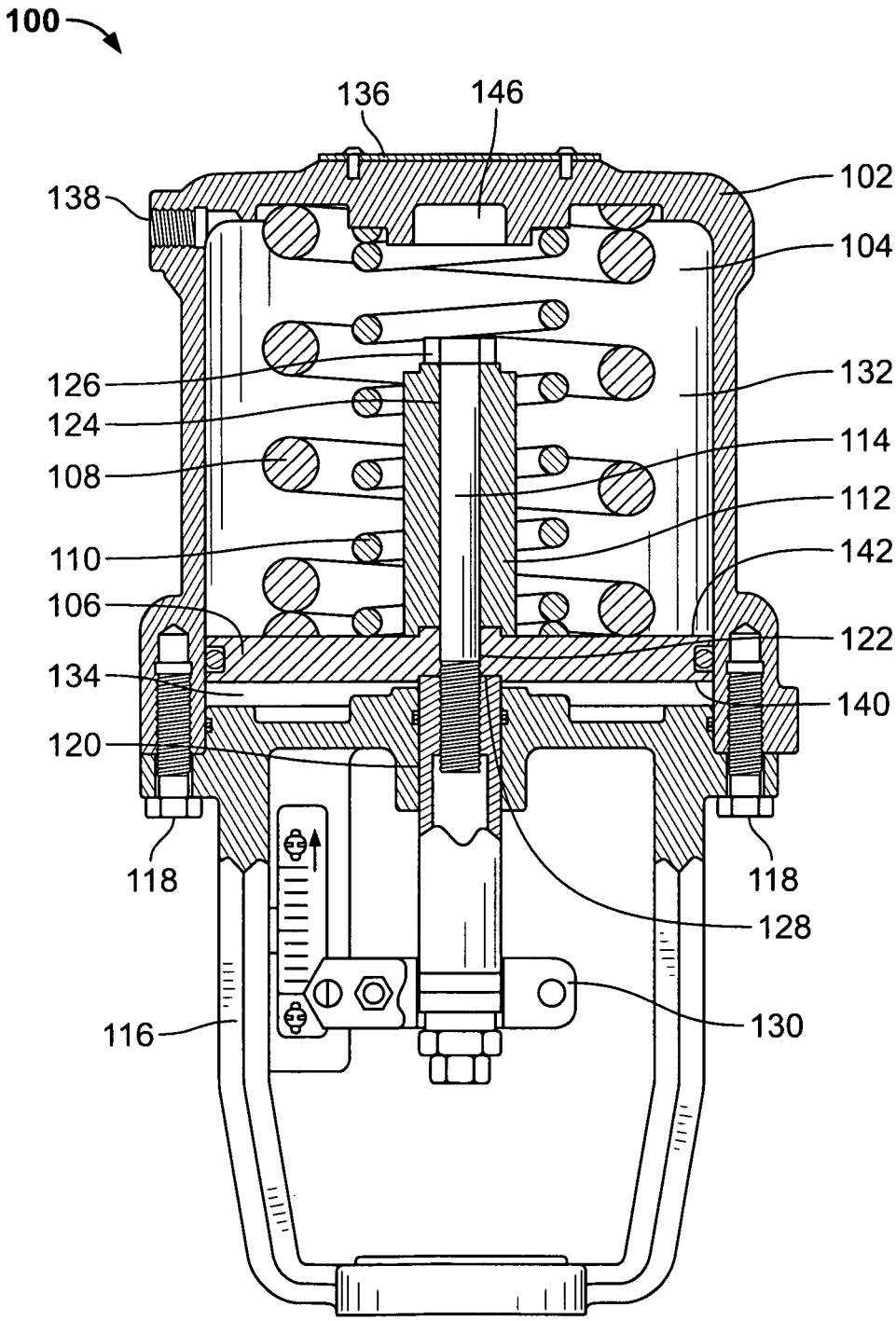
FIG. 1 (Prior Art)
FIG. 1 depicts a known piston actuator.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

Unlike the above-described known piston actuators the volume (e.g., chamber volume) of the example piston actuators described herein can each be field adjusted. In particular, the example field adjustable piston actuators described herein enable manufacturers, vendors and/or customers to stock fewer components, because the same piston actuator may be field adjusted for use in different applications having different stroke length requirements without compromising dynamic performance of the actuator.

In some examples, a plurality of C-shaped clamps are coupled together via a plurality of fasteners. To change the chamber volume of some of these piston actuators, the C-shaped clamps may be decoupled by removing the plurality of fasteners. The C-shaped clamps may then be moved away from each other until a lug formed by each of the C-shaped clamps are at a distance from one of a plurality of ribs formed along an exterior surface of a yoke. The C-shaped clamps are then moved to be adjacent to (e.g., to engage) a different rib, which corresponds to a different chamber volume, and the C-shaped clamps are then moved toward each other until the different rib is positioned adjacent the lug. The C-shaped clamps may then be recoupled together.

In other examples, a plurality of L-shaped clamps may be positioned to partially overlap. To change the chamber volume of these example piston actuators, tie rods, which couple different components of the piston actuator together, may be removed from the L-shaped clamps. The L-shaped clamps may then be moved away from each other until a lug of the L-shaped clamps are moved away from one of a plurality of ribs formed along an exterior surface of a yoke. The L-shaped clamps are then moved to be adjacent a different rib, which corresponds to a different chamber volume, and the L-shaped clamps are then moved toward each other until the lug is positioned adjacent the different rib. The L-shaped clamps may then be recoupled together by positioning the tie rods through apertures defined by the L-shaped clamps.

In still other examples, a plate is coupled to an externally accessible shaft, which threadingly engages another plate. To change the chamber volume of these example piston actuators, an operator may grasp a handle coupled to the shaft and turn the handle either clockwise or counter clockwise to change the position of the plate relative to a piston positioned in the chamber. The shaft may be provided with indicators to indicate the position of the shaft relative to the piston actuator and, thus, the chamber volume.

FIG. 1 depicts a known piston actuator 100 that includes a cylinder 102 that defines a chamber 104 in which a piston 106, a plurality of springs 108 and 110, a travel stop 112 and a portion of an actuator stem 114 are positioned. The cylinder 102 is coupled to a yoke 116 via a plurality of fasteners 118.

The actuator stem 114 is positioned through an aperture 120 defined by the yoke 116, an aperture 122 defined by the piston 106 and an aperture 124 defined by the travel stop 112. To couple the piston 106 and the travel stop 112 to the actuator stem 114, a nut 126 is threaded onto the actuator stem 114 such that the piston 106 is positioned between a surface 128 of the actuator stem 114 and the travel stop 112.

In practice, the piston actuator 100 may be coupled to a valve (e.g., a globe valve, a sliding stem valve, etc.) (not shown) to control the flow of the fluid through the valve. In particular, the piston actuator 100 may be used to control the position of a fluid control element (e.g. a plug) (not shown) within the valve. The fluid control element is operatively coupled to a connector 130 of the actuator stem 114. In operation, to move the fluid control element within the valve, a pressure difference is provided across a first chamber portion 132 and a second chamber portion 134. For example, to move the fluid control element away from an orifice (not shown) to enable fluid to flow through the valve, the actuator stem 114 may be moved toward an end 136 of the cylinder 102 by exhausting fluid through a first port 138 to decrease the pressure in the first chamber portion 132 and by pumping fluid (e.g., air) though a second port (not shown) to increase the pressure in the second chamber portion 134. As the pressure in the second chamber portion 134 increases, the force exerted against a first surface 140 of the piston 106 also increases (e.g., force=pressure*area) and overcomes a force exerted against a second surface 142 of the piston 106 via the pressure in the first chamber portion 132 and a spring force exerted by the plurality of springs 108 and 110. As a result, the piston 106 and the actuator stem 114 move toward the end 136 until the nut 126 engages a recess 146 defined by the cylinder 102.

Alternatively, to move the fluid control element toward the orifice to substantially stop the flow of fluid through the valve, the piston 106 may be moved toward the yoke 116 by pumping fluid through the first port 138 to increase the pressure in the first chamber portion 132 and by exhausting fluid though the second port to decrease the pressure in the second chamber portion 134. As the pressure in the first chamber portion 132 increases, the force exerted against the second surface 142 also increases (e.g., force=pressure*area) and, in addition to the force exerted by the plurality of springs 108 and 110, overcomes the force exerted against the first surface 140 via the pressure in the second chamber portion 134. As a result, the piston 106 and the actuator stem 114 move toward the yoke 116 to change the position of the fluid control element within the valve.

To enable the piston actuator 100 to be used in different applications, the stroke length of the piston actuator 100 may be changed. To do so, the fasteners 118 are loosened and the cylinder 102 is removed from the yoke 116. The nut 126 is then removed from the actuator stem 114 and the travel stop 112 is replaced with a different size (e.g., a travel stop having a different length) travel stop 112. Once the different size travel stop 112 is positioned relative to the actuator stem 114, the nut 126 is again threaded onto the actuator stem 114. The cylinder 102 is then repositioned relative to the yoke 116 and the fasteners 118 are retightened. While interchanging different size travel stops 112 enables the stroke length of the piston actuator 100 to change, the overall volume of the chamber 104 remains the same, which, if the available volume is larger than necessary for the stroke length, can compromise the dynamic performance of the piston actuator 100. To counteract the impact on the dynamic performance of the piston actuator 100, different piston actuators 100 having different stroke lengths and cylinder 102 volumes that are tailored to the particular applications may be used. However, such an approach requires manufacturers, vendors and/or customers to stock many different parts that are associated with the different piston actuators, which results in production, control and logistics problems as well as increased costs.

Figure 2A:
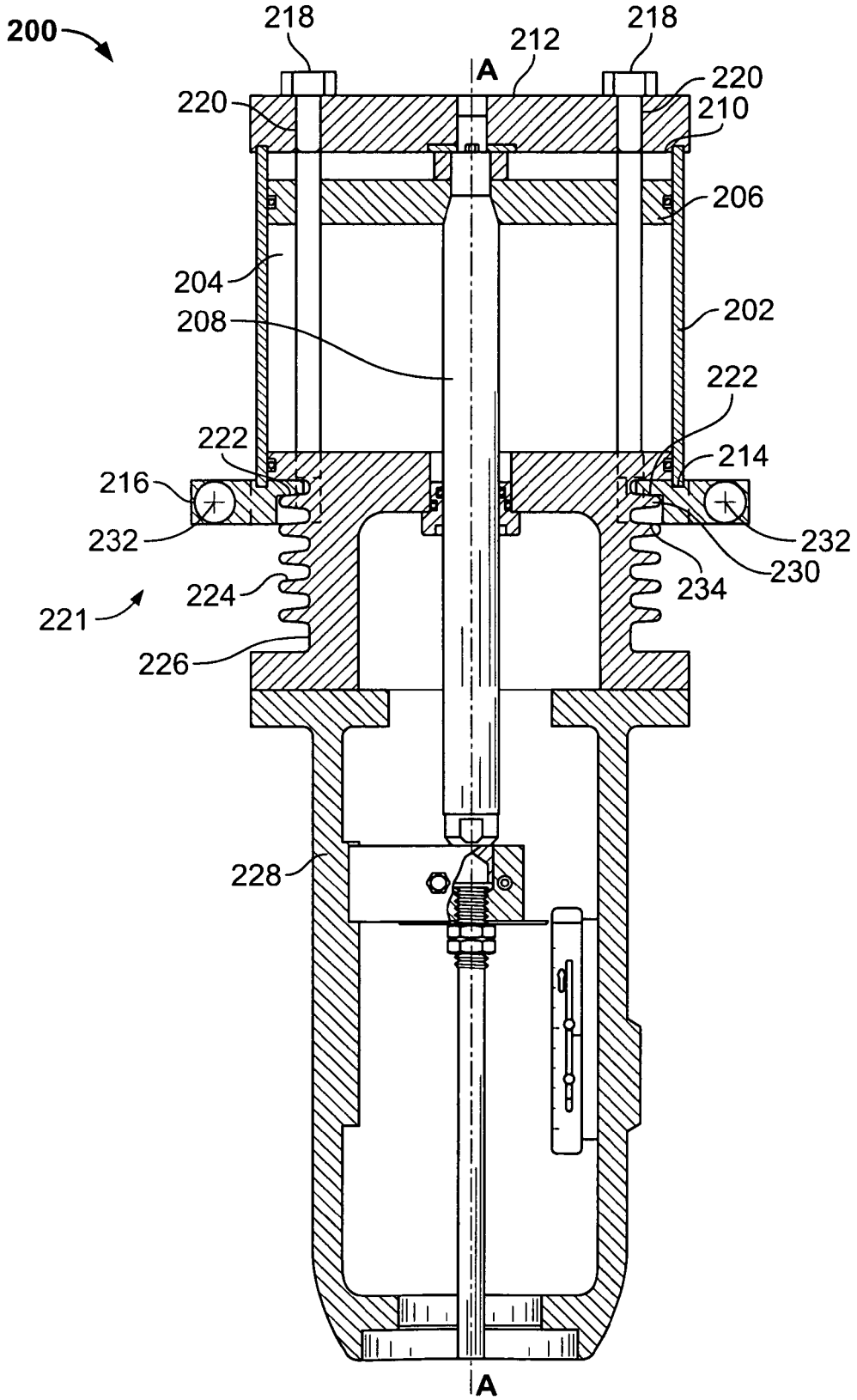
FIG. 2A depicts an example piston actuator.

FIG. 2A depicts an example piston actuator 200 that includes a cylinder or housing 202 that defines a chamber 204 in which a piston 206 and a portion of an actuator stem or shaft 208 are positioned. The housing 202 includes a first opening 210 adjacent a first plate 212 and a second opening 214 adjacent a second plate 216. To couple the first plate 212, the housing 202 and the second plate 216 together, a plurality of tie rods 218 may be positioned though apertures 220 of the first plate 212 and threaded into the second plate 216. While not shown, the piston actuator 200 may be provided with springs (not shown) to bias, the piston 206 to, for example, a fail safe position.

To enable the volume of the example piston actuator 200 to be adjusted, the piston actuator 200 is provided with a volume adjuster 221. In particular, in some examples, the volume adjuster 221 includes the second plate 216 that includes a lug 222 configured to engage and be positioned adjacent each of a plurality of ribs 224 formed along an exterior surface 226 of a yoke 228. As described in greater detail below, positioning the lug 222 adjacent different ribs 224 adjusts the volume of the chamber 204. In some examples, the ribs 224 may be equally spaced from one another such as, for example, in one-quarter inch increments, in one-half inch increments, etc. However, in other examples, the different ribs 224 may not be equally spaced from one another such that, for example, some of the ribs 224 are spaced one-quarter inch apart and some of the other ribs 224 are spaced one-half inch apart. Additionally, it should be appreciated that the lug 222 may be fully circumferential, interrupted or provided in a crenellated manner to form a plurality of lugs.

In practice, if the lug 222 of the second plate 216 is positioned adjacent a first rib 230 and a plurality of fasteners 232 are tightened to secure the second plate 216, the housing 202 and the first plate 212 relative to the yoke 228, the chamber 204 may have a first volume. Alternatively, if the lug 222 of the second plate 216 is positioned adjacent a second rib 234 and the plurality of fasteners 232 are tightened to secure the second plate 216, the housing 202 and the first plate 212 relative to the yoke 228, the chamber 204 may have a second volume.

Thus, the volume of the chamber 204 may be adjusted incrementally to enable the example piston actuator 200 to be implemented in different applications having different stroke length requirements without compromising the dynamic performance of the piston actuator 200. As such, the examples described herein enable manufacturers, vendors and/or customers to stock fewer components, because, in contrast to the known piston actuator 100 of FIG. 1, the volume of the example piston actuator 200 may be field adjusted to tailor the volume of the chamber 204 to a particular application.

Figure 2B:
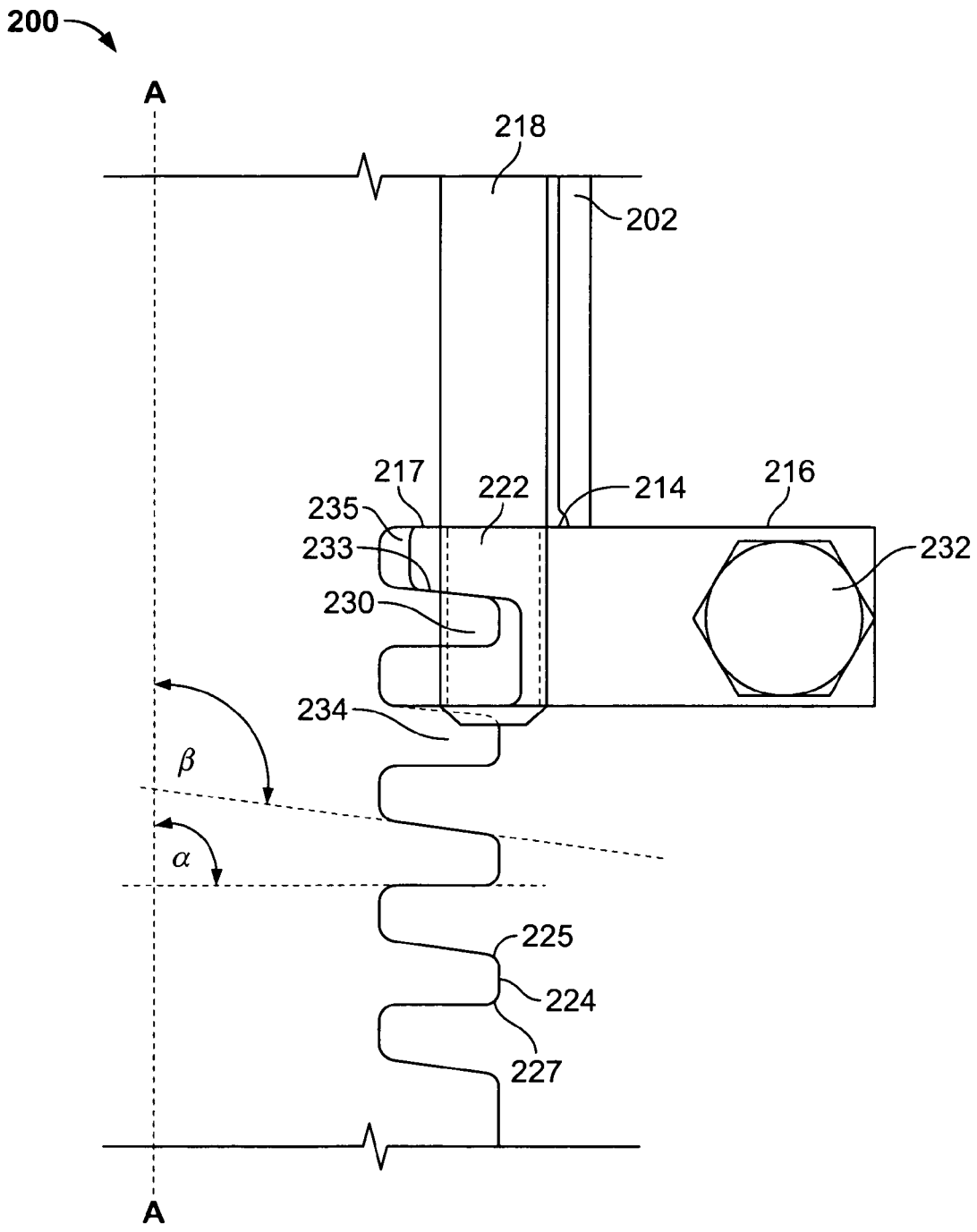
FIG. 2B depicts a more detailed partial cross-sectional view of the example piston actuator of FIG. 2A.

As depicted in partial cross-section in FIG. 2B, the plurality of ribs 224 and the lug 222 may include a geometric arrangement to substantially align an actuator axis A-A of the housing 202 and the piston 206 (FIG. 2A) to substantially eliminate any misalignment or binding when the actuator 200 is stroked. More particularly, the lug 222 may have a first surface 217 (e.g., an upper surface) that forms approximately a right angle $\alpha$ with respect to the actuator axis A-A and a second surface 233 (e.g., a lower surface, a tapered surface) that forms approximately an obtuse angle $\beta$ with respect to the actuator axis A-A. The plurality of ribs 224 include corresponding mating surfaces for the lug 222. Specifically, each of the ribs 224 includes a third surface 225 (e.g., an upper surface, a tapered surface) that forms approximately an obtuse angle $\beta$ with respect to the actuator axis A-A and a fourth surface 227 (e.g., a lower surface) that forms approximately a right angle $\alpha$ with respect to the actuator axis A-A. More generally, the first surface 217 of the lug 222 corresponds to the fourth surface 227 of the first rib 230 and the second surface 233 of the lug 222 corresponds to the third surface 225 of the second rib 234, such that as the fasteners 232 are tightened to couple the second plate 216, the housing 202 and the first plate 212 relative to the yoke 228, the lug 222 is drawn into the recess 235, via the interaction between the second surface 233 and the third surface 225, which substantially ensures that the housing 202 is properly aligned relative to the piston 206. Thus, as the fasteners 232 are tightened, the corresponding first and second surfaces 217 and 233 of the lug 222 engage the fourth and third surfaces 227 and 225 of the ribs 224. The third surface 225 (e.g., a sloped surface) of each of the ribs 224 creates a clamping force upon the corresponding second surface 233 of the lug 222 to securely fasten the housing 202 to the yoke 228 (FIG. 2A). The interaction between first surface 217 of the lug 222 and the fourth surface 227 of the ribs 224 provides a substantially perpendicular arrangement of the piston 206 (FIG. 2A) with respect to the housing 202 to eliminate axial misalignment and, therefore, eliminate binding during operation.

Figure 3:
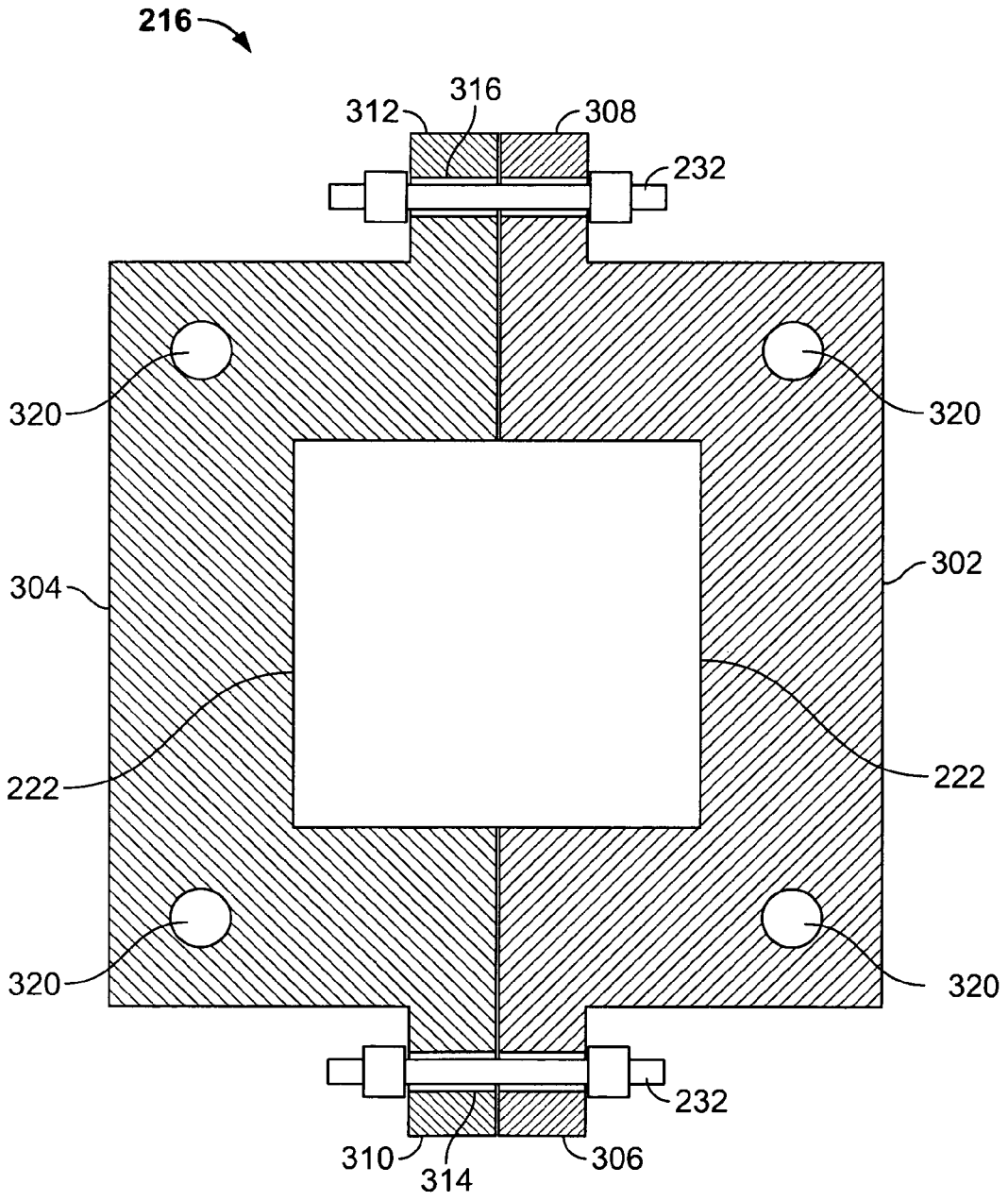
FIG. 3 depicts a more detailed view of the example second plate used to implement the example piston actuator of FIG. 2A.

Turning to FIG. 3, a more detailed view of the second plate 216 of FIG. 2A is shown. The second plate 216 includes a first C-shaped clamp 302 and a second C-shaped clamp 304. To couple the C-shaped clamps 302 and 304 together, each C-shaped clamp 302 and 304 is provided with a plurality of flanges 306, 308, 310 and 312 that define apertures 314 and 316 through which one of the plurality of fasteners 232 is positioned. Additionally, each of the C-shaped clamps 302 and 304 defines a plurality of apertures or holes 320 (e.g., threaded holes) that are to receive one of the tie rods 218 (FIG. 2A) to couple the first plate 212 (FIG. 2A), the housing 202 (FIG. 2A) and the second plate 216 together. In some examples, the tie rods 218 (FIG. 2A) may thread into respective ones of the holes 320. However, in other examples, the tie rods 218 (FIG. 2A) may be positioned through the holes 320 and receive a nut (not shown) to couple each of the tie rods 218 to the second plate 216.

In practice, in some examples, to change the volume of the chamber 204 (FIG. 2A), the tie rods 218 (FIG. 2A) may be removed from the second plate 216 to decouple the second plate 216 from the first plate 212. The C-shaped clamps 302 and 304 are then decoupled by removing the plurality of fasteners 232 and moving the C-shaped clamps 302 and 304 away from each other until the first rib 230 is moved away from the lug 222, respectively. Once the lug 222 is positioned adjacent the second rib 234, the C-shaped clamps 302 and 304 are again moved toward each other until the second rib 234 is positioned adjacent the lug 222. The fasteners 232 are then repositioned in the apertures 314 and 316 to recouple the C-shaped clamps 302 and 304 together. The tie rods 219 are then threaded into the holes 320 to couple the first plate 212, the housing 202 and the second plate 216 together.

Figure 4:
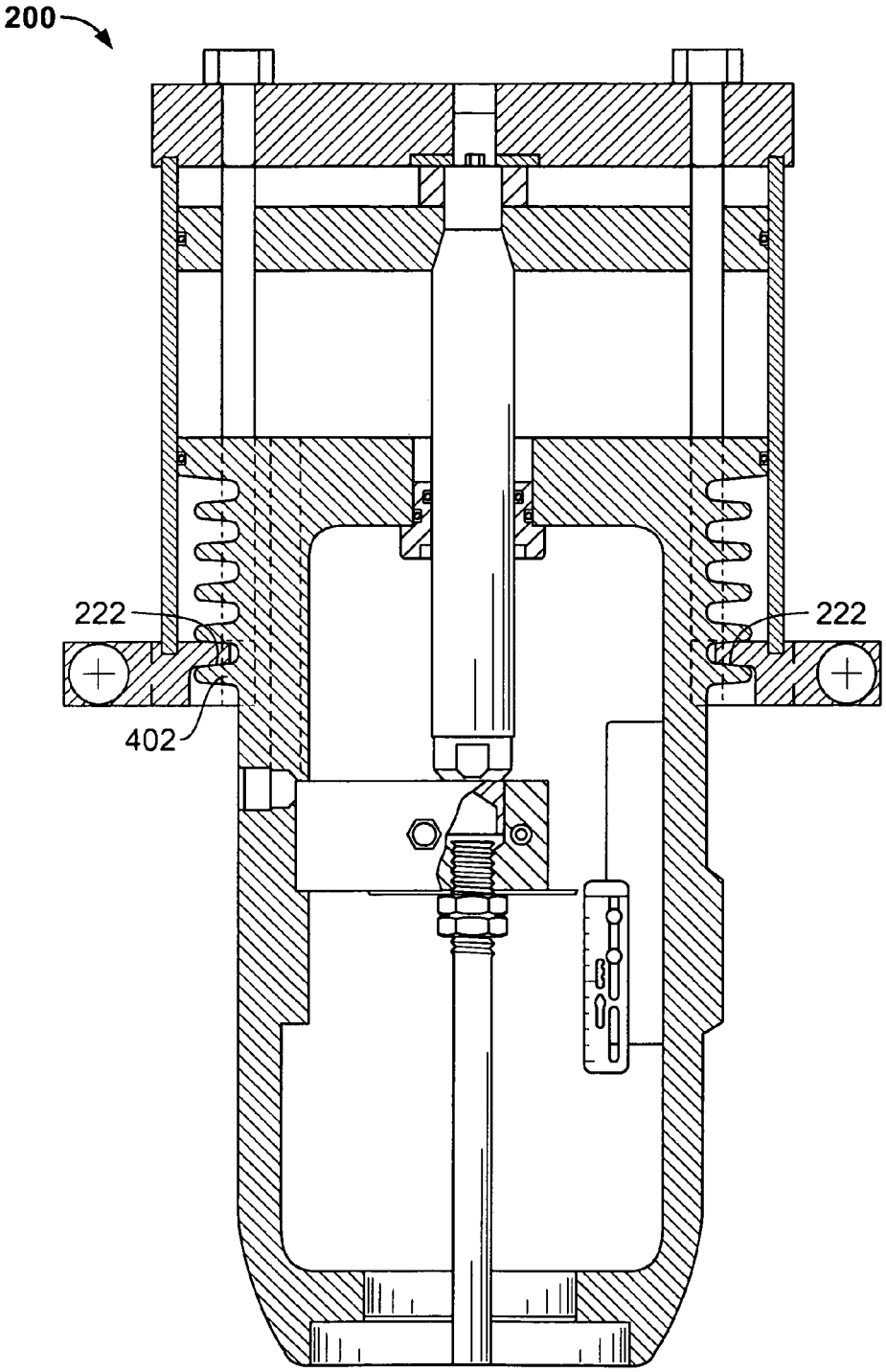
FIG. 4 depicts the example piston actuator of FIG. 2A in a different position.

FIG. 4 depicts the example piston actuator 200 of FIG. 2A with the lug 222 positioned adjacent a third rib 402 such that the chamber 204 has a third volume.

FIGS. 5-9 depict an example piston actuator 500 that is substantially similar to the piston actuator 200 of FIGS. 2A and 4. However, the piston actuator 500 includes a second plate 502 that includes a lug 504 that may be positioned adjacent each of a plurality of ribs 506 formed along an exterior surface 508 of a yoke 510 of the piston actuator 500. In practice, positioning the lug 504 adjacent different ribs 506 adjusts the volume of a chamber 514. In some examples, the ribs 506 may be equally spaced from one another such as, for example, in one-quarter inch increments, in one-half inch increments, etc. However, in other examples, the different ribs 506 may not be equally spaced from one another such that, for example, some of the ribs 506 are spaced one-quarter inch apart and some of the other ribs 506 are spaced one-half inch apart.

Figure 9:
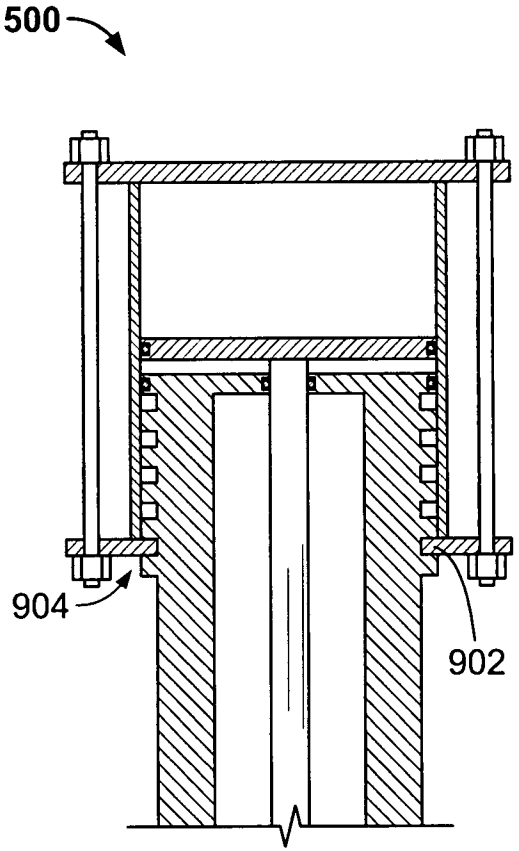
Figure 10:
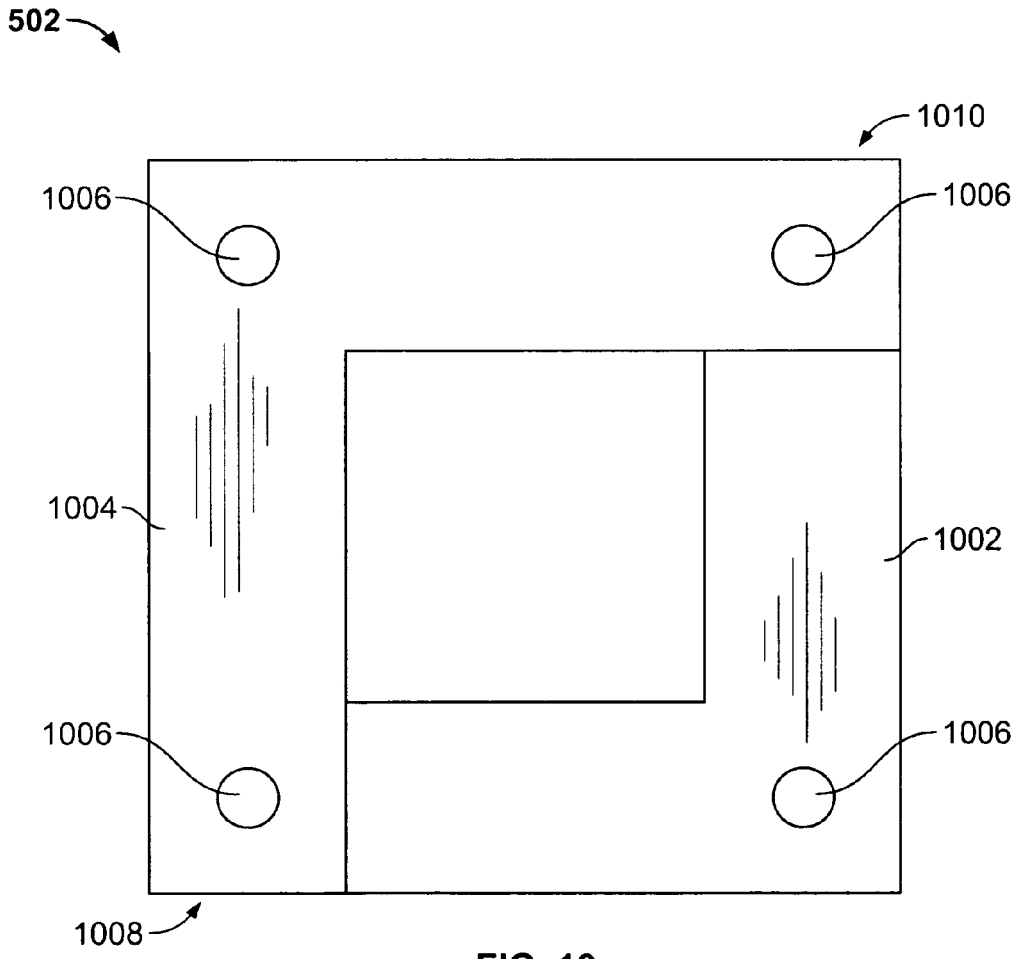
FIG. 10 depicts a more detailed view of the example second plate used to implement the example piston actuator of FIGS. 5-9.

Also referring to FIG. 10, a more detailed view of the second plate 502 of FIGS. 5-9 is shown. The second plate 502 includes a first L-shaped clamp 1002 and a second L-shaped clamp 1004 that may be substantially similar to the first L-shaped clamp 1002. To couple the first L-shaped clamp 1002 and the second L-shaped clamp 1004 together, the L-shaped clamps 1002 and 1004 are positioned such that holes 1006 of a first overlapping section 1008 align and holes 1006 of a second overlapping section 1010 align. Next, tie rods 516 (FIG. 5) are positioned through the holes 1006 to couple the L-shaped clamps 1002 and 1004, a first plate 518 (FIG. 5) and a housing or cylinder 520 (FIG. 5) together. In some examples, the tie rods 516 (FIG. 5) may thread into respective ones of the holes 1006. However, in other examples, the tie rods 516 (FIG. 5) may be positioned through the holes 1006 and receive respective nuts (not shown) to couple each of the tie rods 516 (FIG. 5) to the second plate 502.

As discussed above, to change the volume of the chamber 514, the tie rods 516 may be removed from the second plate 502 to decouple the second plate 502, the first plate 518, the first L-shaped clamp 1002 (FIG. 10) and the second L-shaped clamp 1004 (FIG. 10). The L-shaped clamps 1002 and 1004 (FIG. 10) are then moved away from each other until the lug 504 is moved away from the respective one of the ribs 506. The L-shaped clamps 1002 and 1004 (FIG. 10) are again moved toward each other once the lug 504 is positioned adjacent a desired different one of the ribs 506 and the holes 1006 FIG. 10) of the first and second overlapping sections 1008 and 1010 (FIG. 10) are aligned. The tie rods 516 are then threaded into the holes 1006 (FIG. 10) to couple the L-shaped clamps 1002 and 1004 (FIG. 10), the first plate 518 and the housing 520 together.

Figure 7:
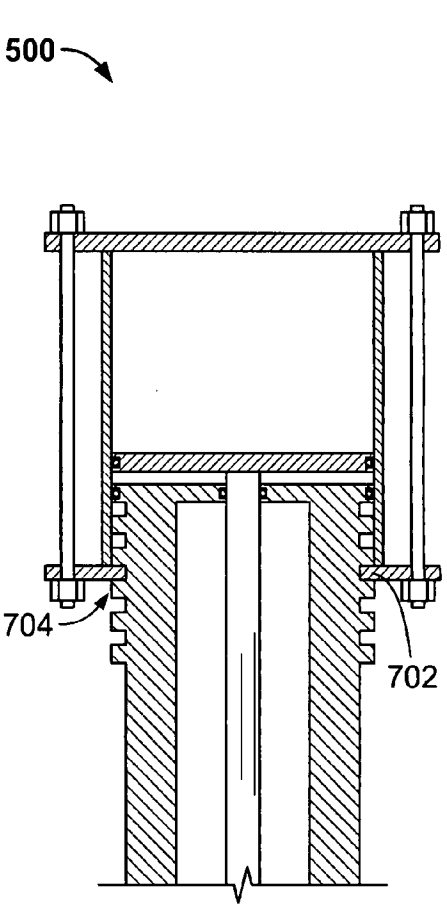
FIGS. 5-9 depict another example piston actuator in various positions.
Figure 6:
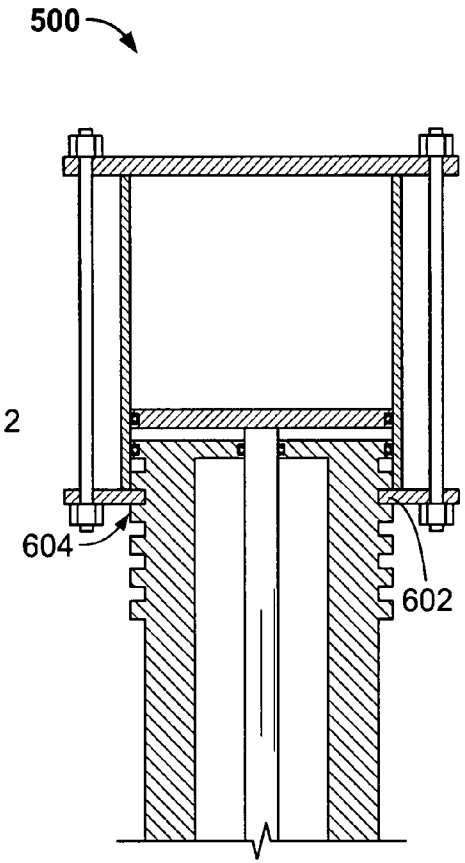
Figure 5:
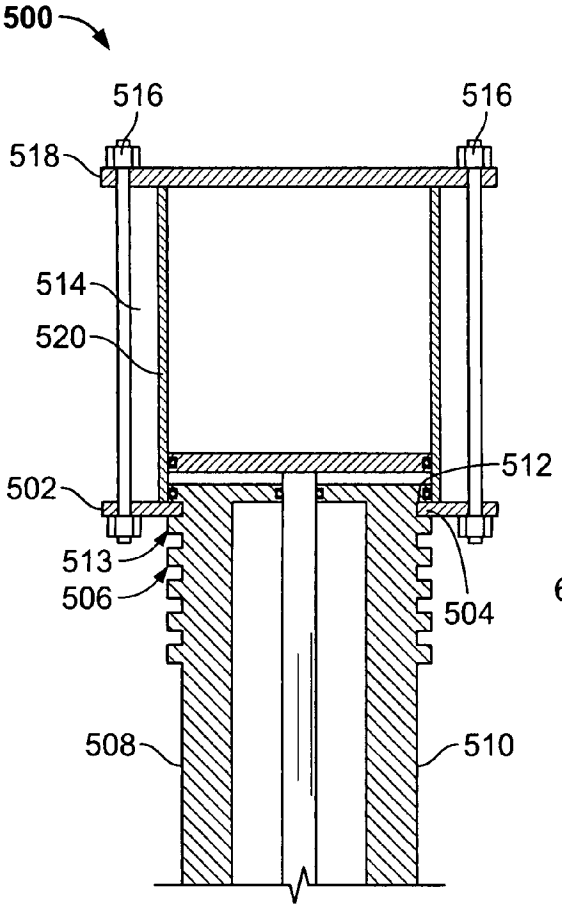
Figure 8:
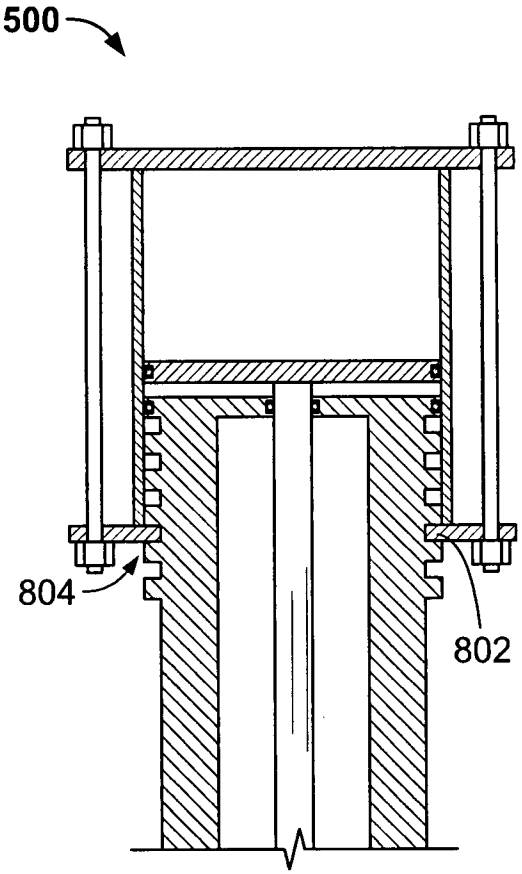

FIG. 5 depicts the lug 504 positioned in a first groove 512 between a first set of adjacent ribs 513 and, thus, the chamber 514 of the piston actuator 500 has a first volume. FIG. 6 depicts the lug 504 positioned in a second groove 602 between a second set of adjacent ribs 604 and, thus, the chamber 514 of the piston actuator 500 has a second volume. FIG. 7 depicts the lug 504 in a third groove 702 between a third set of adjacent ribs 704 and, thus, the chamber 514 of the piston actuator 500 has a third volume. FIG. 8 depicts the lug 504 in a fourth groove 802 between a fourth set of adjacent ribs 804 and, thus, the chamber 514 of the piston actuator 500 has a fourth volume. FIG. 9 depicts the lug 504 in a fifth groove 902 between a fifth set of adjacent ribs 904 and, thus, the chamber 514 of the piston actuator 500 has a fifth volume. While FIGS. 5-9 depict the piston actuator 500 having five ribs to adjust the volume of the chamber 514, the piston actuator 500 may have any number of ribs (2, 3, 4, 5, 6, etc.) and, thus, any number of incremental adjustments, positions or configurations.

Figure 11:
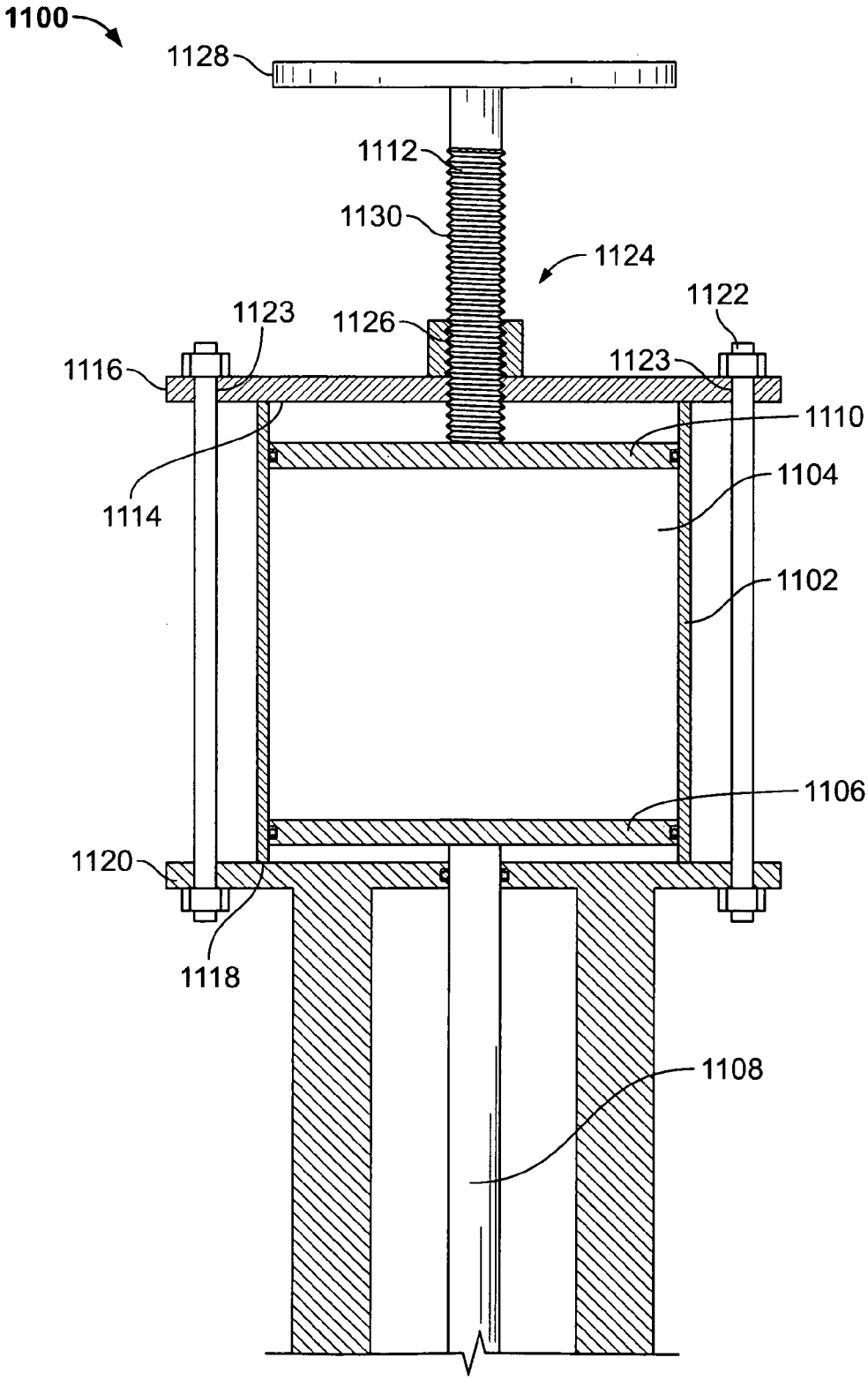
FIGS. 11-12 depict another example piston actuator in different positions.

FIG. 11 depicts an example piston actuator 1100 that includes a housing or cylinder 1102 that defines a chamber 1104 in which a piston 1106, a portion of an actuator stem or shaft 1108, a first plate 1110 and a portion of a shaft 1112 are positioned. The housing 1102 includes an opening 1114 adjacent a third plate 1116 and another opening 1118 adjacent a second plate 1120. To couple the housing 1102, the third plate 1116 and the second plate 1120 together, a plurality of tie rods 1122 may be positioned though apertures 1123 of the third plate 1116 and threaded into the second plate 1120. While not shown, the piston actuator 1100 may be provided with springs (not shown) to bias, the piston 1106 in, for example, a fail safe position.

To adjust the volume of the example piston actuator 1100, the piston actuator 1100 is provided with a volume adjuster 1124. In particular, in some examples, the volume adjuster 1124 includes the first plate 1110 that is coupled to the shaft 1112 to enable incremental adjustment of the shaft 1112 and, thus, the first plate 1110. The shaft 1112 threadingly engages an aperture 1126 of the third plate 1116. In practice, rotating the shaft 1112 via, for example, a handle or turn wheel 1128, moves the first plate 1110 toward or away from the third plate 1116 to increase or decrease the volume of the chamber 1104, respectively. In some examples, the shaft 1112 may be provided with indicators or markers (not shown) along an exterior surface 1130 of the shaft 1112 to indicate the position of the first plate 1110 relative to the chamber 1104. The indicators or markers may be equally spaced along the exterior surface 1130. However, in other examples, the indicators or markers may not be equally spaced along the exterior surface 1130.

To change the volume of the chamber 1104, an operator may grasp the handle 1128 and, in some examples, turn the handle 1128 clockwise to move the first plate 1110 toward the piston 1106 and, thus, decrease the volume of the chamber 1104. Alternatively, the operator may grasp the handle 1128 and, in some examples, turn the handle 1128 counter clockwise to move the first plate 1110 away from the piston 1106 and, thus, increase the volume of the chamber 1104. The external position of the handle 1128 relative to the piston actuator 1100 enables the operator to relatively easily field adjust the volume of the chamber 1104 without having to disassemble the piston actuator 1100. In some examples, to secure the position of the shaft 1112 and, thus, the piston 1106 relative to the housing 1102, the piston actuator 1100 may be provided with a locking mechanism (not shown).

Figure 12:
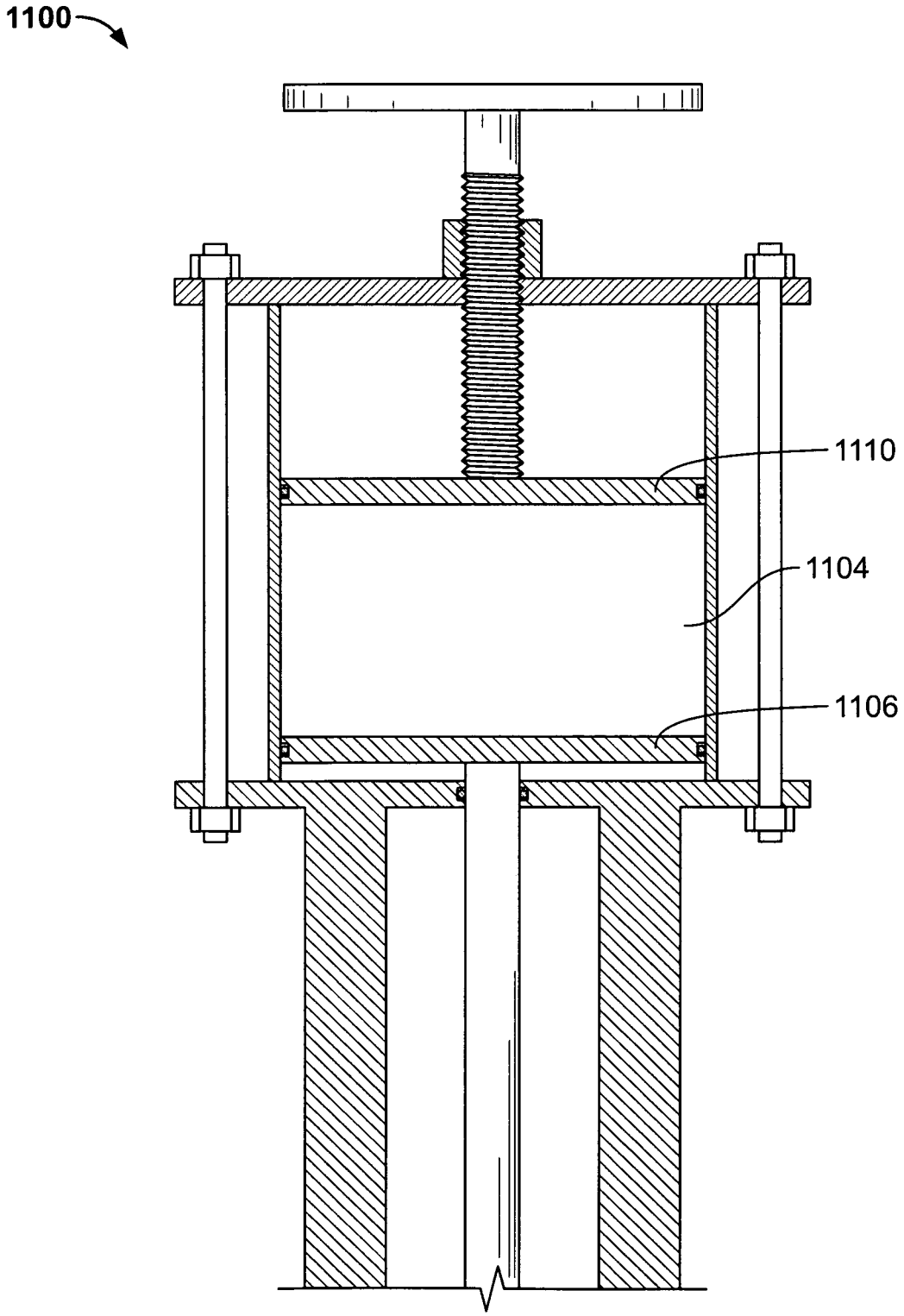

FIG. 11 depicts the first plate 1110 relatively close to the third plate 1116 and, thus, the volume of the chamber 1104 is relatively large. In contrast, FIG. 12 depicts the first plate 1110 relatively closer to the piston 1106 and, thus, the volume of the chamber 1104 is relatively small.

Figure 13:
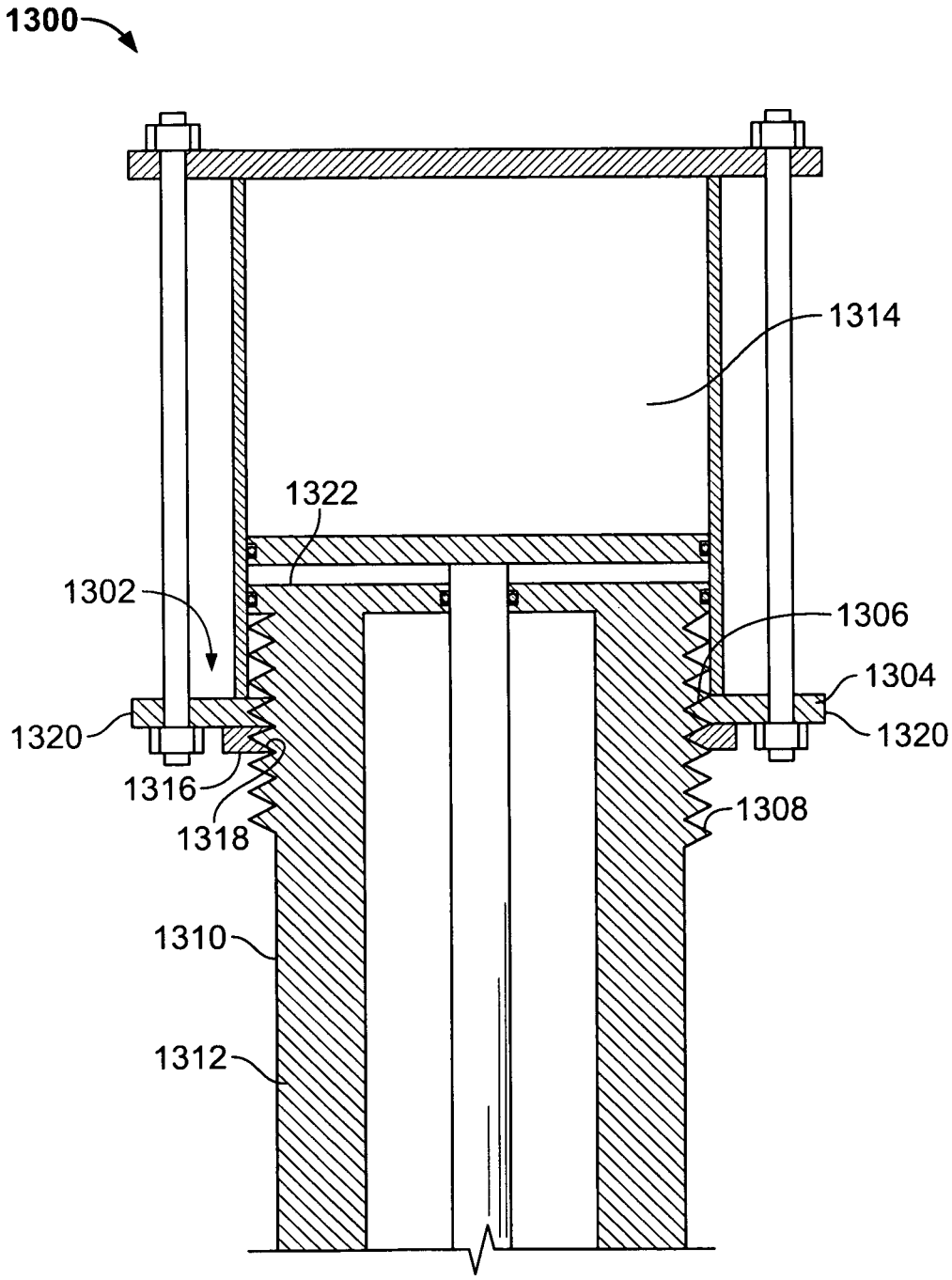
FIG. 13 depicts another example piston actuator.

FIG. 13 depicts an example piston actuator 1300 that is similar to the piston actuators 200 and 500 of FIGS. 2A, 4, and 5-9. However, the piston actuator 1300 includes a volume adjuster 1302 that includes a second plate 1304 that is provided with threads 1306 that threadingly engage threads 1308 along an exterior surface 1310 of a yoke 1312 of the piston actuator 1300. Rotating the second plate 1304 relative to the yoke 1312 increases or decreases the volume of a chamber 1314 of the piston actuator 1300. To secure the second plate 1304 relative to the yoke 1312, the piston actuator 1300 is provided with a locking mechanism or lock nut 1316 that defines threads 1318 that threadingly engage the threads 1308 along the exterior surface 1310. In operation, when the second plate 1304 is positioned in the desired position relative to the yoke 1321, the lock nut 1316 is tightened (e.g., rotated to engage the second plate 1304) to prevent the second plate 1304 from moving from the desired position.

In some examples, the yoke 1312 may be provided with indicators or markers (not shown) along the exterior surface 1310 to indicate the position of the second plate 1304 relative to the yoke 1312 and, thus, the volume of the chamber 1314. The indicators or markers may be equally spaced along the exterior surface 1310. However, in other examples, the indicators or markers may not be equally spaced along the exterior surface 1310.

To change the volume of the chamber 1314, an operator may grasp a surface 1320 of the second plate 1304 via, for example, a tool (not shown), and turn the second plate 1304 clockwise to move the second plate 1304 away from an end 1322 of the yoke 1312 and, thus, decrease the volume of the chamber 1314. Alternatively, the operator may grasp the surface 1320 and turn the second plate 1304 counter-clockwise to move the second plate 1304 toward the end 1322 and, thus, increase the volume of the chamber 1314. The external position of the volume adjuster 1302 enables the operator to relatively easily field adjust the volume of the chamber 1314 without having to disassemble the piston actuator 1300.

Figure 14:
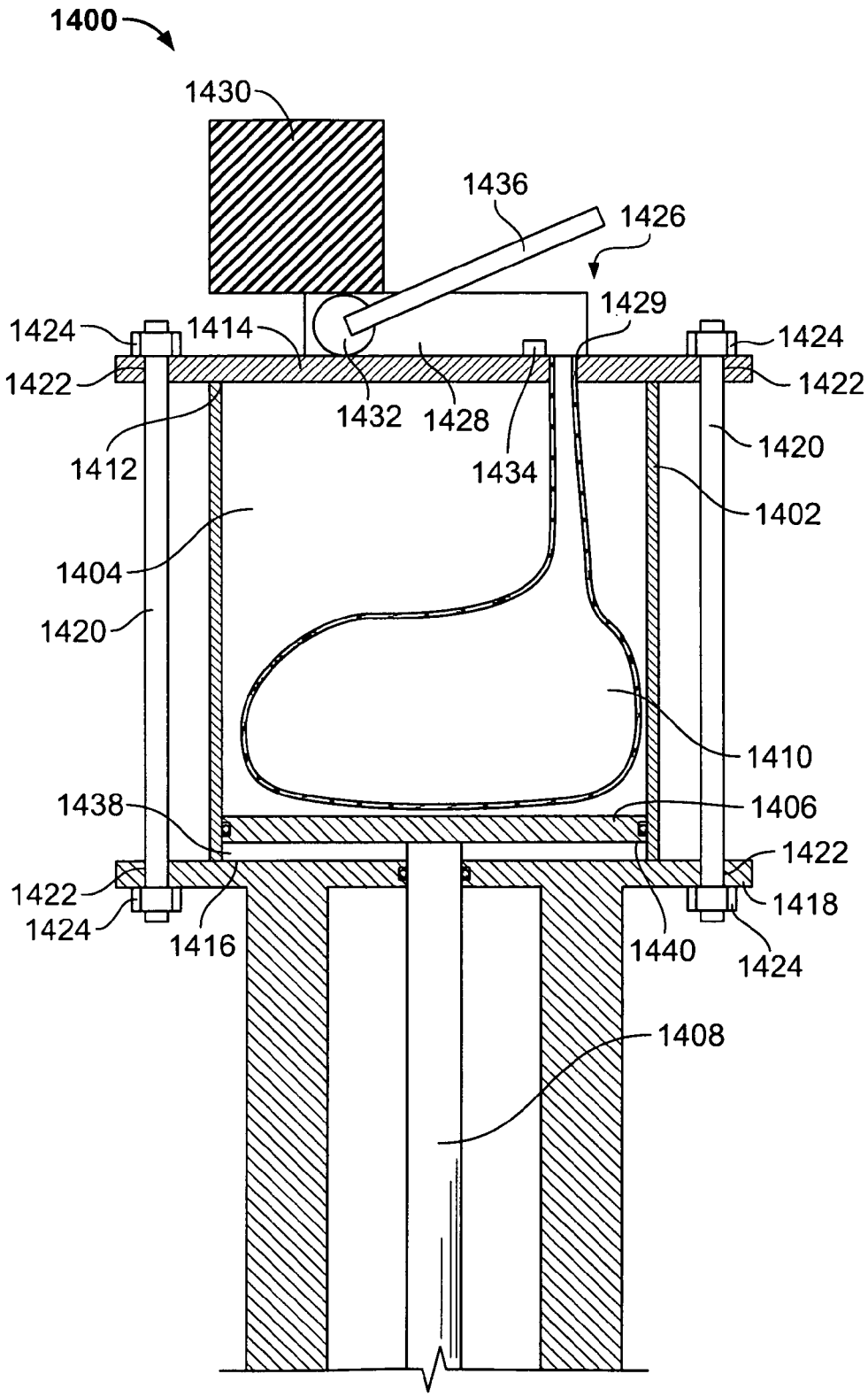
FIG. 14 depicts yet another example piston actuator.

FIG. 14 depicts yet another example piston actuator 1400 that includes a housing or cylinder 1402 that defines a chamber 1404 in which a piston 1406, a portion of an actuator stem or shaft 1408, and a container or bladder 1410 are positioned. The housing 1402 includes an opening 1412 adjacent a first plate 1414 and another opening 1416 adjacent a second plate 1418. To couple the housing 1402, the first plate 1414 and the second plate 1418 together, a plurality of tie rods 1420 may be positioned though apertures 1422 of the first and second plates 1414 and 1418 and secured via nuts 1424.

To adjust the volume of the example piston actuator 1400, the piston actuator 1400 is provided with a volume adjuster 1426. In particular, in some examples, the volume adjuster 1426 includes the bladder 1410 that is fluidly coupled to a pump 1428 (e.g., a hydraulic pump, a manual pump) through an aperture 1429 defined in the first plate 1414. The pump 1428 fluidly couples the bladder 1410 to a reservoir 1430 (e.g., a hydraulic fluid reservoir), which may house a substantially non-compressible fluid. The pump 1428 is provided with a check valve 1432 (e.g., a fluid control device) to control the flow of fluid between the reservoir 1430 and the bladder 1410. Additionally, the pump 1428 may be provided with a sensor 1434 to identify the amount of fluid in the bladder 1410 and, thus, a volume occupied by the bladder 1410 in the chamber 1404.

In operation, the volume of air in the chamber 1404 has the greatest impact on the dynamic performance of the piston actuator 1400 because air is a compressible fluid. Therefore, changing the volume of air in the chamber 1404 by increasing or decreasing the amount of non-compressible fluid in the chamber 1404 (e.g., in the bladder 1410) enables the piston actuator 1400 to be implemented in different applications having different stroke length requirements without compromising the dynamic performance of the piston actuator 1400. To change the volume of air (e.g., compressible fluid) in the chamber 1404, an operator may move a lever 1436 of the pump 1428 to actuate the check valve 1432 to an open position to enable fluid to flow between the reservoir 1430 and the bladder 1410. To increase the volume of fluid in the bladder 1410, the pump 1428 pumps fluid (e.g., a non-compressible fluid) from the reservoir 1430 to the bladder 1410 to increase the amount of fluid in the bladder 1410, which decreases the volume of air in the chamber 1404. Once the desired amount of fluid is in the bladder 1410, the operator moves the lever 1436 to actuate the check valve 1432 to a closed position to substantially prevent additional fluid from flowing between the reservoir 1430 and the bladder 1410.

Alternatively, to decrease the volume of fluid in the bladder 1410, after the check valve 1432 is actuated to the open position, the pump 1428 pumps fluid from the bladder 1410 to the reservoir 1430, which increases the volume of air in the chamber 1404. Once the desired amount of fluid is in the bladder 1410, the operator moves the lever 1436 to actuate the check valve 1432 to the closed position to substantially prevent additional fluid from flowing between the reservoir 1430 and the bladder 1410. In other examples, to decrease the volume of fluid in the bladder 1410, after the check valve 1432 is actuated to the open position, a pressure in a chamber 1438 positioned below the piston 1406 is pressurized to exert a force against a surface 1440 of the piston 1406 to move the piston 1406 toward the first plate 1414. As the piston 1406 moves toward the first plate 1414, the piston 1406 compresses the bladder 1410 and pushes the fluid out of the bladder 1410 through the aperture 1429 and toward the reservoir 1430.

While the piston actuator 1400 is depicted as having the bladder 1410 positioned in the chamber 1404, the piston actuator 1400 may not be provide with the bladder 1410. In such examples, after the check valve 1432 is actuated to the open position, fluid enters the chamber 1404 through the aperture 1429 to decrease a volume of air in the chamber 1404. Alternatively, to decrease the amount of fluid in the chamber 1404, the pressure in the chamber 1438 below the piston 1406 is pressurized to exert a force against the surface 1440 of the piston 1406 to move the piston 1406 toward the first plate 1414 and push the fluid from the chamber 1404 through the aperture 1429 and toward the reservoir 1430.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A field adjustable piston actuator, comprising:

a housing having a chamber;

a first bracket and a second bracket;

an actuator yoke to be coupled to the housing, wherein the actuator yoke comprises a recess, the recess comprises a first recess portion and a second recess portion, the first recess portion to receive the first bracket and the second recess portion to receive the second bracket, the first and second brackets to be removably coupled together, the first and second recess portions further comprise tapered surfaces to enable the first and second brackets to be drawn into the first and second recess portions to couple and coaxially align the housing and the actuator yoke; and a piston assembly comprising a piston and a stem, the piston to be positioned within the chamber and the stem to be coupled to the piston and to extend through the yoke.

2. The field adjustable piston actuator as defined in claim 1, wherein the yoke comprises a first rib and a second rib along an exterior surface of the yoke to be engaged by lugs of the respective first and second brackets, the recess is at least partially defined by the first rib or the second rib, wherein positioning the lugs adjacent the first rib is associated with a first chamber volume and positioning the lugs adjacent the second rib is associated with a second chamber volume that is different than the first chamber volume.

3. The field adjustable piston actuator as defined in claim 2, wherein the lugs comprise second tapered surfaces that correspond to the tapered surfaces of at least one of the first rib or the second rib.

4. The field adjustable piston actuator as defined in claim 1, wherein the first bracket and the second bracket are to be coupled together via at least one fastener.

5. The field adjustable piston actuator as defined in claim 1, wherein the stem is to control the position of a fluid flow control member of a valve.

6. The field adjustable piston actuator as defined in claim 1, wherein the housing at least partially surrounds the yoke.

7. The field adjustable piston actuator as defined in claim 6, wherein the first and second brackets enable a distance between an end of the housing and an exterior surface of the yoke to change the volume of the chamber.

8. The field adjustable piston actuator as defined in claim 1, wherein the yoke comprises a first rib and a second rib extending from an exterior surface of the yoke, the ribs comprise a first surface and a second surface, the first surface comprises the tapered surface to enable lugs of the respective first and second brackets to be drawn into the recess between the ribs to align the housing relative to the piston assembly.

9. The field adjustable piston actuator as defined in claim 8, wherein the tapered surface comprises a substantially obtuse angle relative to an axis of the housing.

10. The field adjustable piston actuator as defined in claim 8, wherein the lugs comprise third and fourth surfaces to engage the first and second surfaces of the rib.

11. The field adjustable piston actuator as defined in claim 1, wherein the first recess portion is spaced apart from the second recess portion and the first recess portion opposes the second recess portion.

12. A field adjustable piston actuator, comprising:

a housing having a chamber;

an actuator yoke to be coupled to the housing;

a piston assembly comprising a piston and a stem, the piston to be positioned within the chamber and the stem to be coupled to the piston and to extend through the yoke; and a volume adjuster to provide field adjustment to change a volume of the chamber, the volume adjuster comprises a recess to receive a portion of the housing or the actuator yoke, the recess further comprises a tapered surface to enable the portion to be drawn into the recess to coaxially align the housing and the actuator yoke, wherein the volume adjuster comprises the yoke having a first rib and a second rib along an exterior surface of the yoke to be engaged by a lug of a plate of the housing, the recess is at least partially defined by the first rib or the second rib, wherein positioning the lug of the plate adjacent the first rib is associated with a first chamber volume and positioning the lug of the plate adjacent the second rib is associated with a second chamber volume that is different than the first chamber volume, wherein the plate comprises brackets coupled together via at least one fastener, wherein the brackets comprise a plurality of opposing C-shaped brackets each having at least one flange to receive one of the at least one fastener.

13. The field adjustable piston actuator of claim 12, wherein the portion comprises the lug.

14. A field adjustable piston actuator, comprising:

a housing having a chamber;

an actuator yoke to be coupled to the housing;

a piston assembly comprising a piston and a stem, the piston to be positioned within the chamber and the stem to be coupled to the piston and to extend through the yoke; and a volume adjuster to provide field adjustment to change a volume of the chamber, the volume adjuster comprises a recess to receive a portion of the housing or the actuator yoke, the recess further comprises a tapered surface to enable the portion to be drawn into the recess to coaxially align the housing and the actuator yoke, wherein the volume adjuster comprises the yoke having a first rib and a second rib along an exterior surface of the yoke to be engaged by a lug of a plate of the housing, the recess is at least partially defined by the first rib or the second rib, wherein positioning the lug of the plate adjacent the first rib is associated with a first chamber volume and positioning the lug of the plate adjacent the second rib is associated with a second chamber volume that is different than the first chamber volume, wherein the plate comprises brackets coupled together via at least one fastener, wherein the brackets comprise a plurality of L-shaped brackets that are to at least partially overlap.

15. The field adjustable piston actuator of claim 14, wherein the portion comprises the lug.

16. A field adjustable piston actuator, comprising:

a housing having a chamber;

an actuator yoke to be coupled to the housing;

a piston assembly comprising a piston and a stem, the piston to be positioned within the chamber and the stem to be coupled to the piston and to extend through the yoke; and a volume adjuster to provide field adjustment to change a volume of the chamber, the volume adjuster comprises a recess to receive a portion of the housing or the actuator yoke, the recess further comprises a tapered surface to enable the portion to be drawn into the recess to coaxially align the housing and the actuator yoke, wherein the volume adjuster comprises the yoke having a first rib and a second rib extending from an exterior surface of the yoke, the ribs comprise a first surface and a second surface, the first surface comprises the tapered surface to enable a lug of the housing to be drawn into the recess between the ribs to align the housing relative to the piston assembly, wherein the second surface comprises a substantially right angle relative to an axis of the housing.

17. The field adjustable piston actuator of claim 16, wherein the portion comprises the lug.

18. A piston actuator assembly, comprising:

a housing having opposing openings and a chamber;

a piston assembly comprising a piston and a stem, the piston to be positioned within the chamber and the stem to be coupled to the piston and to extend through a yoke;

a first plate coupled to the housing and adjacent one of the opposing openings;

means for providing field adjustment to change a volume of the chamber to correspond to a stroke length of a device to which the piston actuator is to be coupled, the means for providing field adjustment to change the volume of the actuator comprises a bracket comprising a first portion and a second portion, the first and second portions to be removably coupled together to couple the housing and the yoke, and wherein a first recessed portion of the yoke is to receive the first portion of the bracket, and a second recessed portion of the yoke is to receive the second portion of the bracket.

19. The piston actuator assembly as defined in claim 18, wherein the means for providing field adjustment to change the volume of the chamber comprises the yoke having a first rib and a second rib along an exterior surface of the yoke that corresponds to a lugs of the respective first and second portions, wherein positioning the lugs adjacent the first rib is associated with a first chamber volume and positioning the lugs adjacent the second rib is associated with a second chamber volume that is different than the first chamber volume.

20. The piston actuator assembly as defined in claim 19, wherein the first rib is relatively closer to an end of the yoke than the second rib.

21. The piston actuator assembly as defined in claim 19, wherein the first portion and the second portion are to be coupled together via at least one fastener.

22. The piston actuator assembly as defined in claim 21, wherein the portions comprise a plurality of opposing C-shaped brackets each having at least one flange to receive one of the at least one fastener.

23. The piston actuator assembly as defined in claim 21, wherein the portions comprise a plurality of L-shaped brackets that are to at least partially overlap.

24. The piston actuator assembly as defined in claim 19, wherein the stem is to control the position of a fluid flow control member of a valve.

25. An actuator, comprising:

a yoke;

a housing at least partially surrounding and movably coupled to the yoke, the housing comprising a chamber and first and second portions, the first and second portions to be removably coupled together and to the yoke, a volume of the chamber to change based on a position of the first and second portions relative to the yoke, the volume to be adjusted based on a stroke length of a device to which the actuator is to be coupled; and a piston movably positioned within the chamber.

26. The actuator of claim 25, wherein the yoke comprises a recess to receive the first and second portions, the recess comprises tapered surfaces to enable the the first and second portions to be drawn into the recess to coaxially align the housing and the yoke.

* * * * *

UNITED STATES PATENT AND TRADEMARK OFFICE

CERTIFICATE OF CORRECTION

PATENT NO. : 8,689,675 B2
APPLICATION NO. : 12/363496
DATED : April 8, 2014
INVENTOR(S) : Michael W. McCarty It is certified that error appears in the above-identified patent and that said Letters Patent is hereby corrected as shown below:

In the Claims:

In Column 11, line 31 (Claim 18): Add --and-- after "openings;"

In Column 12, line 39 (Claim 26): Delete "the" between "the" and "first."

Signed and Sealed this
Fifteenth Day of July, 2014

Michelle K. Lee

Michelle K. Lee
*Deputy Director of the United States Patent and Trademark Office*